United States Patent [19]

Zerillo

[11] 4,194,846

[45] Mar. 25, 1980

[54] DOT MATRIX PRINTING DEVICE EMPLOYING A NOVEL IMAGE TRANSFER TECHNIQUE TO PRINT ON SINGLE OR MULTIPLE PLY PRINT RECEIVING MATERIALS

[75] Inventor: Samuel D. Zerillo, Nashua, N.H.

[73] Assignee: Centronics Data Computer Corp., Hudson, N.H.

[21] Appl. No.: 901,182

[22] Filed: Apr. 28, 1978

[51] Int. Cl.[2] ..... B41J 3/12; B41J 27/04

[52] U.S. Cl. ..... 400/124; 400/471.1

[58] Field of Search ..... 400/124, 470, 471, 471.1; 101/93.05

[56] References Cited

U.S. PATENT DOCUMENTS

| | | | |
|---|---|---|---|
| 3,241,522 | 3/1966 | Knight | 400/202.2 X |
| 3,400,801 | 9/1968 | Swenson | 400/202.2 |
| 3,929,071 | 12/1975 | Cialone et al. | 400/126 X |

FOREIGN PATENT DOCUMENTS

| | | | |
|---|---|---|---|
| 2152241 | 4/1973 | Fed. Rep. of Germany | 400/124 |
| 2546835 | 4/1977 | Fed. Rep. of Germany | 400/124 |

OTHER PUBLICATIONS

"Print Wire Inking System", IBM Tech. Disc. Bulletin, by J. E. Lisinski, vol. 14, No. 10, Mar. 1972, p. 2980.

"Self-Inking Matrix Printer", IBM Tech. Disc. Bulletin, by R. G. Cross, vol. 19, No. 5, Oct. 1976, p. 1538.

*Primary Examiner*—Paul T. Sewell

*Attorney, Agent, or Firm*—Lerner, David, Littenberg & Samuel

[57] ABSTRACT

A printer having at least one reciprocally mounted printing member controlled to impact against a printing surface by selective energization of an associated printing driving member. The forward end of the member is guided by a bearing. Ink from a supply source is directed to the printing member near the forward end of the printing member whereby the ink is drawn into the region between the guide hole in the printing member guide bearing and the periphery of the printing member to be moved to the region in front of the forward tip of the printing member whereby activation of the driving member abruptly moves the printing member in the forward printing direction causing the ink deposited upon the tip of the printing member to be urged toward and against the ink receiving medium to transfer the ink to the ink receiving medium. A group of printing members may be used to print in this manner to collectively form characters, symbols, and even graphic patterns.

18 Claims, 3 Drawing Figures

DOT MATRIX PRINTING DEVICE EMPLOYING A NOVEL IMAGE TRANSFER TECHNIQUE TO PRINT ON SINGLE OR MULTIPLE PLY PRINT RECEIVING MATERIALS

BACKGROUND OF THE INVENTION

Dot matrix printers presently in use employ ink as the printing means and are typically designed in accordance with one of the two following concepts:

(1) Directly applying ink to the print receiving material to form the specified character. Such printers are typically referred to as "ink jet printers," as shown, for example, in U.S. Pat. No. 3,281,859.

(2) Transferring ink contained within an ink carrying medium such as a fiber ribbon saturated with ink and positioned adjacent to the print receiving material whereby transfer occurs by impacting the inked ribbon against the ink receiving material. Printers of this type are generally referred to as "impact type printers." One typical printer of the dot matrix type is shown in U.S. Pat. No. 3,833,105, assigned to the assignee of the present application.

These two basic designs have a number of disadvantages, some of the more significant ones being:

(1) The ink jet method of printing is complicated, expensive, and cannot be used to print on multiple ply print receiving material.

(2) The complex and delicate nature of ink jet printers require constant maintenance and the concept employed requires constant generation of a stream of ink dots, even when not printing at selected positions on the ink receiving material, causing a great deal of wasteful employment of unused ink and requiring a complex collection and recirculation means.

(3) In impact printers employing inked ribbons, the print density and quality is non-uniform as usage of the ribbon increases, especially due to the non-uniform manner in which ink is transferred from the ribbon to the ink receiving material. This is due to the extraction of the ink by the constant impact of the print wires. The ink is extracted from the ribbon up to the point where characters being printed become illegible and the ribbon must therefore be changed.

(4) The ribbon manufacturing process is costly and complicated and many of its associated problems affect the life and performance of the ribbon.

(5) Inked ribbons must be changed frequently. The changing operation is time-consuming and messy.

(6) Printers employing inked ribbons must be provided with complicated mechanical assemblies necessary for guiding and moving the ribbon between the print head and the print medium, further adding to the maintenance, cost and problems of the printer.

(7) Due to the short life of inked ribbons some designs provide for re-inking of the ribbon while in use on the printer. Such operations are costly, have low efficiency, and are greatly affected by the environmental conditions as well as the ribbon fabric to the extent that any adverse condition will destroy whatever gains might be available through the use of the re-inking process.

BRIEF DESCRIPTION OF THE INVENTION

The present invention avoids all of the disadvantages of the prior art while providing a highly simplified printing arrangement. The basic concept of the present invention is characterized by directly flowing ink to the tips of the print wires employed in dot matrix impact printers, whereby the print wires, when driven by their operating solenoids, cause the ink deposited upon the tips of the print wires to be transferred to the print receiving material.

Ink is supplied to the wire tips from an ink cartridge mounted upon the print head and communicating with the print wires by means of a suitable conduit. Means may also be provided to collect excess ink during the printing operation.

In one preferred embodiment, the ink is directed to the print wires at a location slightly inward from the tips of the print wires, which are guided by a suitable guide bearing. The ink enters through capillary action into the bores in the bearing which surround the outer peripheries of the print wires. The ink moves along the aforementioned narrow cylindrical shaped region between the print wires and the bores and is deposited on the tips of the print wires which, when activated by their solenoids, cause the ink deposited upon the tips of the print wires to be transferred to the ink receiving material.

BRIEF DESCRIPTION OF THE FIGURES AND OBJECTS OF THE INVENTION

One object of the present invention is to provide a printer of the impact type capable of printing characters and patterns upon an ink receiving material while totally eliminating the need for inked ribbons.

Still another object of the present invention is to provide a novel printing method and apparatus employing impact members wherein ink is transferred to a print receiving material by application of ink to the printing members which impact the ink receiving medium, totally eliminating the need for inked ribbons and their attendant guiding and driving mechanisms.

The above as well as other objects of the present invention will become apparent when reading the accompanying description and drawings in which.

DETAILED DESCRIPTION OF THE INVENTION

Figure 1:
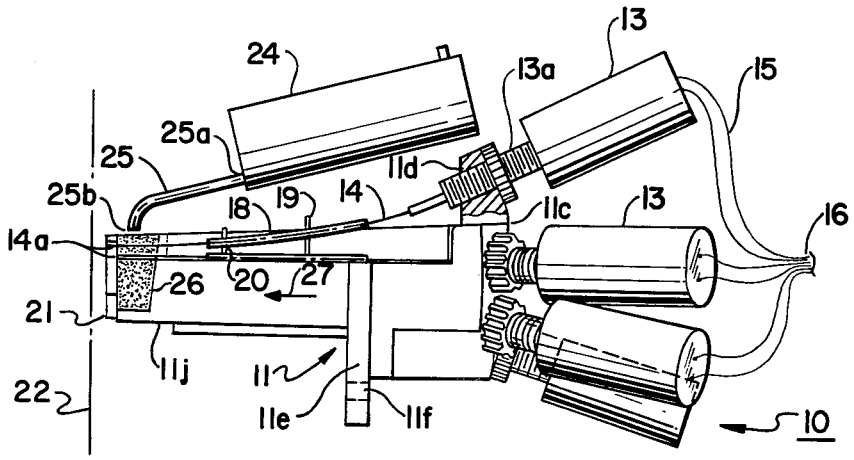
FIG. 1 shows an elevational view of a print head of the dot matrix impact type embodying the principles of the present invention.

FIG. 1 shows a print head 10 of the dot matrix type. The basic design of the print head is substantially similar to that described in the above-mentioned U.S. Pat. No. 3,833,105 and a detailed description of the print head and its manner of operation will be eliminated herein merely for purposes of simplicity. Basically, however, the print head is comprised of a tapered housing member 11. The rear wall **11*c* is provided with a plurality of threaded openings (only opening 11*d* being shown, for purposes of simplicity) each adapted to receive the threaded forward ends 13*a* of a plurality of print wire drive solenoids 13. As shown in FIG. 1, the threaded portion 13*a* threadedly engages the tapped aperture 11*d* in the rear wall 11*c* of housing 11. Typically, seven solenoids 13 are employed. As described in the aforementioned U.S. Pat. No. 3,833,105, showing a print head of the dot matrix impact type, the solenoids are each provided with armatures maintained at rest by spring means and abruptly urged in the forward or impact direction by solenoid coils which are energized for driving print wires 14 in the forward or print direction. The solenoid windings are each provided with electrical leads 15, shown as extending from the solenoids 13 and collected in a bundle 16. The free ends of the leads 16** are electrically connected to solenoid driving circuits (not shown) for selectively energizing the solenoid coils.

The print wires 14 extend through the forward ends of the solenoids in the manner shown best in FIG. 1, and are maintained slightly curved by tube guides 18 which are positioned and secured by a pair of guide plates 19 and 20. Similar plates and tube guides are shown in detail in the above-mentioned U.S. patent directed to dot matrix impact type print heads.

The print wires 14 extend through the hollow tube guides 18 and out of their forward or left hand ends (relative to FIG. 1) and converge generally from the rear of the print head toward the front where they are arranged in rather closely spaced fashion, the print wires 14 being positioned one above the other.

The forward end of the print head housing 11 is fitted with a guide bearing 21 having a plurality of circular shaped apertures typically arranged along an imaginary straight line so as to guide the forward tips of the print wires 14. The bearing 21 is preferably formed of a material having a low coefficient of friction so as to cause insignificant wearing of either the bearing or the print wires as a result of the high speed and continuous reciprocating action of the print wires within the bearings. This structure and arrangement is also described in detail in U.S. Pat. No. 3,833,105.

The print head housing 11 is provided with a mounting flange **11*e* having an opening 11*f*** for securing the print head upon a carriage (not shown) which typically moves relative to the print receiving material to effect printing.

Conventional printing occurs by energizing none, one, or more than one of the solenoid windings at each printing position, typically determined by printing registration means as shown, for example, in FIG. 11 of U.S. Pat. No. 3,703,949, assigned to the assignee of the present invention.

The linear array of print wires typically cause the printing of dot columns wherein five adjacent dot columns typically collectively form a single alphabetic or numeric character or symbol, or for that matter a graphic pattern.

In accordance with the above description, the print head 10 of the present invention is basically the same as that of the prior art. The novel concept of the present invention resides in the fact that ink is transferred to an ink receiving material 22, which may, for example, be a paper web, by means which direct ink to the tips of the print wires while totally eliminating the need for a conventional inked ribbon.

The print head 10 is preferably provided with a cover or lid, shown removed in FIG. 1. The cover fits upon the top of housing 11 and is fastened to the rear wall by fastening members which threadedly engage tapped apertures in the rear wall **11*c***.

An ink reservoir, in the form of a cartridge 24, is positioned upon the upper surface of the lid and is filled with ink in liquid form. The forward end of the cartridge 24 is provided with an opening which communicates with the right hand end **25*a* of a tube 25 which extends generally diagonally downwardly and away from cartridge 24, and has its left hand end 25*b* positioned to deposit ink upon the upper surface of a wick of absorbent material 26 positioned immediately behind bearing 21 and arranged about the print wires 14** so as to substantially surround the print wires.

Cartridge 24 may be disposable and is preferably formed of a flexible thin-walled plastic material. The ink flows by gravity from reservoir 24 into tube 25 and saturates or wets the wick 26.

The reciprocating action of the print wires draws the ink into the region between the cylindrical surface of the print wires and the cylindrical openings in the bearing, there being only the slightest bit of clearance therebetween. The ink, however, is drawn into this region by capillary action.

The operation may be described as follows:

The ink reservoir 24 conveys ink to the wicking material 26 through conduit 25. The wicking material engages the print wires 14 and is positioned immediately behind the bearing 21, which may be a jewel bearing such as, for example, a bearing formed of ruby or sapphire. Alternatively, the bearing may be formed of a suitable plastic material having good hardness qualities while at the same time having a low coefficient of sliding friction, to reduce wearing of both the bearing and the print wires.

The bearing is provided with a plurality of bores, each being circular so as to conform to the circular cross-section of the print wires 14. Obviously, any other shapes may be employed, if desired, so long as the bores conform to the cross-section of the print wires. For example, the cross-section of the print wires 14 may be oval, square, rectangular, or other polygonal shapes with the shape of the bore being in conformity therewith.

The bores provide for the unimpeded reciprocating action of the print wires which are driven toward the impact direction, shown by arrow 27, when the solenoids are energized and return to the "rest" state by suitable spring means provided within the solenoid housing, said print wires moving in the reverse direction to that shown by arrow 27 so as to be retracted from the printing medium 22 as shown by the dotted line. It is preferred that a platen or other backing surface be provided to the left of the printing medium 22 to permit the print wires to impact against the printing medium without piercing or tearing the printing medium.

The clearance between the bores and the outer peripheries of the print wires 14 is quite small, typically in the range of from 0.001 to 0.0001 inches. However, the clearance is sufficient to enable ink applied to the outer peripheries of the print wires by the wicking material immediately behind the bearing 21, to be drawn into the region between the wires and the bores by capillary action. The ink is drawn in the forward direction, as shown by arrow 27, so as to be deposited upon the forward printing tips **14*a* of each of the print wires 14**.

Energization of the solenoids causes the print wires to move in the print direction shown by arrow 27, and to be impacted against the ink receiving medium 22 so as to transfer ink deposited upon the tips **14*a*, which are impacted against the medium 22, to be transferred to the ink receiving medium 22**. The shape of the area of ink transferred to the ink receiving medium is typically the same as the shape of the print wire, i.e., a substantially circular dot in the case where the print wire has a circular cross-section. Obviously, other cross-sectional shapes will cause the formation of areas on the ink receiving medium to assume a shape conforming to such cross-section. If desired, for example, the wires may be printing members having a configuration conforming to an alphabetic letter or a number, enabling ink to be deposited upon the ink receiving medium which forms an area conforming to the shape of the desired letter, number, symbol, or other graphic pattern.

Printing of selective dots within a 5-column ×7-row matrix enables the formation of any one of the conventional alpha-numeric characters and conventional punctuation symbols, and mathematical symbols. The manner of forming said characters is described in detail in the aforementioned patents dealing with dot matrix impact printers, and will be omitted herein for purposes of simplicity.

In the event that an excess amount of ink is directed to the wicking material 26, such excess ink may be collected within a holding tank 40 (see FIG. 2) arranged beneath the underside 11*j* of print head housing 11. The bottom of the wicking material 26 may extend into the holding tank in the manner shown in FIG. 2.

The excess ink may collect in the holding tank 40 and the wicking material through capillary action may actually draw ink upwardly from tank 40 when no further ink is directed to the wicking material from the tank 40.

Figure 2:
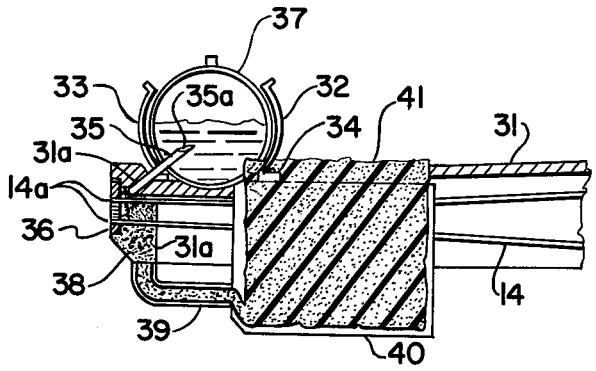
FIG. 2 shows the front portion of a print head in which another alternative embodiment of the invention is employed.

FIG. 2 shows another alternative embodiment 30 of the invention wherein the print head housing 31 has mounted upon its upper surface a pair of holding clips 32 and 33, whose lower ends are secured to the housing by fastening means 34.

The nose portion of the print head housing 31 is provided with a drilled hole located just behind the jewel bearing 36 at the forward end of the print head 10, whereby all of the print wires pass through the centerline of said hole. A hypodermic needle 35 has its lower end fitted into the upper end of hole 31*a* and is preferably fixed in place by a suitable glue so that it rests closely above the print wires with the sharp slanted tip 35*a* pointing upwardly and away from the nose piece. In one embodiment, the needle interior diameter is of the order of 0.015 inches. The inner diameter of the needle is selected as a function of the viscosity of the ink to be utilized. The holding clips 32 and 33 are formed of a spring steel material and are secured to the top of the nose piece by fastening members 34. The clips 32 and 33 are shaped to firmly, and yet releasably hold a cylindrical shaped disposable ink cartridge 37. The hypodermic needle tip 35*a* is positioned between clip members 32 and 33.

The disposable ink cartridge is preferably formed of a flexible thin-walled plastic material so that when it is pressed into place between clips 32 and 33, the needle portion 35*a* penetrates through the wall of cartridge 37 allowing the ink to flow by gravity through the hollow interior of the needle 35 and into the hole provided behind jewel 36, causing the ink to be deposited upon the peripheries of the print wires 14 just behind the jewel 36.

The reciprocating action of the print wires 14 draws the ink in the forward direction and upon the printing tips of the print wires 14 in order to be deposited upon the ink receiving medium 22 (FIG. 1) when the printing tips strike the ink receiving medium.

A wicking material 38 is positioned beneath the print wires to absorb excess ink and thereby prevent it from dripping out from the forward end of the print head. Wicking material 38 extends through tube 39 into the ink tank 40 positioned alongside the print head housing 31. An absorbent replaceable foam material 41 may be inserted into tank 40 whereby excess ink which flows through wick 38 into tank 40 is first collected in the bottom section of the tank and is then absorbed by the foam material 41. The foam material can be removed when it is fully saturated with ink and can be discarded and replaced by a fresh one.

Figure 3:
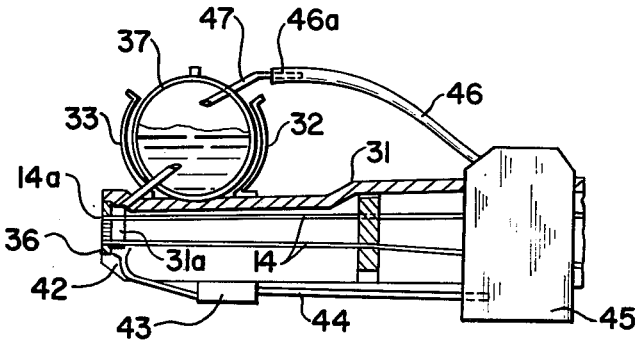
FIG. 3 shows a sectional view of a portion of the front end of a dot matrix impact print head showing still another preferred embodiment of the present invention.

FIG. 3 shows a closed loop system wherein like elements, with regard to FIG. 2, are designated by like numerals. The system is principally the same as that of FIG. 2, which is of an open loop design, but provides a closed loop design in which excess ink is circulated back into use. The excess ink is collected at a point beneath the print wires, through the wick or through a tube 42 having a funnel shaped top portion positioned beneath the print wires. The ink is transferred into an excess ink tank 43 located beneath print head housing 31. A small pump 45 mounted upon the exterior of the print head pulls ink from excess tank 43 through collection tube 44 and then outwardly through return tube 46, whose free end 46*a* is fitted with a hypodermic type needle 47 which pierces the wall of cartridge 37 to return the excess ink to cartridge 37. The ink may thus be recirculated until it is fully depleted.

The above descriptions constitute suitable embodiments for carrying out the objectives of the present invention which reside in the fact that ink is transferred directly to the printing members so as to be deposited upon the printing tip surfaces for transfer of the ink to the ink receiving medium. This totally eliminates the need for conventional inked ribbons as well as eliminating the complex and expensive mechanisms for mounting and driving such inked ribbons.

It should be understood that any other suitable apparatus may be employed for the purpose of delivering the ink to the region of the print wire surfaces which enter into the guiding member so that the ink is drawn forward by capillary action and deposited upon the printing tips of the printing members.

While the invention has been described with a certain degree of particularity, it will be understood that the description was by way of example only and that numerous variations and modifications, as may become apparent to those of ordinary skill in the art, can be made without departing from the spirit and the scope of the invention as hereinafter claimed. For example, solid form materials may be substituted for the liquid ink. Materials such as powdered ink, powdered graphite, and imager powder of the type employed in copier machines have been used in the print heads described hereinabove.

What is claimed is:

1. Printing means for forming a pattern upon an ink receiving medium comprising:

a housing having a hollow interior, said housing having forward and rearward ends;

a reciprocally mounted elongated printing member positioned within said housing and having a forward end with a printing tip;

driving means mounted along said rearward end for normally maintaining said printing member in a first position with said printing tip displaced from said ink receiving medium and for urging said printing tip toward said ink receiving medium when activated;

guiding means provided in the forward end of said housing for guiding the forward end of said elongated printing member to freely enable said reciprocating action, said guiding means having a bore, said bore having a contour conforming to the cross-sectional configuration of the printing member which passes through said bore;

ink supply means; and means comprising a wicking material communicating with said ink supply means and wipingly engaging the peripheral surface of said printing member for delivering ink from said ink supply means to said printing member whereby ink is transferred to a portion of the peripheral surface of the printing member slidably movable into said bore and is delivered to said printing tip for transfer to the print receiving medium when said driving means is actuated.

2. The printing means of claim 1 wherein said wicking material is positioned inside said housing and adjacent to said guiding means and wipingly engages said printing member just behind said guiding means for conveying ink to the peripheral surface of said printing member.

3. The printing means of claim 1 wherein said printing member is an elongated metallic wire and said driving means is a print wire driving solenoid assembly.

4. The printing means of claim 3 wherein said guiding means comprises a bearing member having a low coefficient of friction for receiving and guiding said print wire while minimizing the amount of wearing experienced by both said print wire and said bearing member due to the reciprocating action.

5. The printing means of claim 4 wherein the clearance between the interior surface of the bore in said bearing and the outer periphery of said print wire is sufficient to prevent the print wire from experiencing any play while being sufficient to cause said ink to be drawn into the region between the peripheral surface of the print wire and the interior surface of said bore by capillary action so as to be transferred to the printing tip of the print wire.

6. The printing means of claim 1 wherein said ink supply means includes an ink reservoir positioned beneath said printing member; and said wicking means communicates with the ink in said ink reservoir.

7. The printing means of claim 1 wherein said ink supply means comprises:

a disposable container;

means provided on said housing for releasably holding said disposable container adjacent to said print wires; and hollow tubular piercing means being positioned to pierce an opening in said disposable container when said container is mounted in said releasable holding means whereby the ink in said disposable container may flow through said hollow tubular piercing means and towards said print wires.

8. The printing means of claim 1 wherein said ink supply is positioned above said printing element and ink is caused to flow by gravity towards said printing element.

9. The printing means of claim 1 wherein the shape of the area of ink transferred to the ink receiving medium is determined by the shape of the printing tip.

10. A print head of the dot matrix type comprising:

a hollow housing having forward and rearward ends;

a plurality of reciprocally mounted elongated slender print wires positioned in said housing and having forward and rearward ends;

solenoid driving means each mounted upon the rearward end of said housing and being coupled to the rearward end of an associated print wire for normally maintaining its associated print wire in a first non-printing position and for urging its associated print wire in a printing direction when activated;

print wire guiding means positioned in the forward end of said housing and arranged to maintain the forward ends of the print wires in a predetermined pattern and including a plurality of bores, each receiving and guiding an associated reciprocating print wire, the shape of each bore conforming to the cross-sectional configuration of its associated print wire;

a supply of ink; and means in said housing comprising wicking material communicating with said ink supply and wipingly engaging all of said print wires for applying ink to said print wires in the region behind said guiding means whereby ink is drawn into the region between the outer peripheries of the print wires and the interior surfaces of said bores by capillary action to move along said bores in the aforesaid printing direction so as to be deposited upon the printing tips of said print wires.

11. The print head of claim 10 wherein the ink supply means include an ink reservoir and said wicking material is positioned adjacent to and behind said guide means.

12. The print head of claim 11 wherein the ink reservoir is positioned beneath the print wires.

13. The print head of claim 11 wherein the ink reservoir is positioned above said print wires.

14. The print head of claim 10 further including:

an ink collection reservoir receiving ink from said wicking material; and means for recirculating ink from said ink collection reservoir back to said ink supply means.

15. The print head of claim 10 wherein said guiding means is adapted to arrange said print wires so that their printing tips substantially lie along an imaginary straight line.

16. The print head of claim 10 wherein said printing wires have a substantially circular cross-section configuration and thereby adapted to form circular-shaped dots upon the surface of the ink receiving material.

17. The print head of claim 1 further comprising intermediate guide means provided in said housing for guiding said reciprocally mounted printed member, the forward end of said intermediate guide means being spaced from said wicking material.

18. The print head of claim 10 further comprising intermediate guide means provided in said housing for guiding the intermediate portions of said print wires and maintaining said print wires in a predetermined arrangement, the forward end of said intermediate guide means being spaced from said wicking material.

* * * * *